US007008307B2

(12) United States Patent
Wolff et al.

(10) Patent No.: US 7,008,307 B2
(45) Date of Patent: Mar. 7, 2006

(54) APPARATUS FOR SHARPENING A CIRCULAR BLADE

(75) Inventors: David H. Wolff, Chesnee, SC (US); James A. O'Donnell, Spartanburg, SC (US); Richard F. Hunter, Jr., Inman, SC (US)

(73) Assignee: Wolff Industries, Spartanburg, SC (US)

( * ) Notice: Subject to any disclaimer, the term of this patent is extended or adjusted under 35 U.S.C. 154(b) by 154 days.

(21) Appl. No.: 10/653,474

(22) Filed: Sep. 2, 2003

(65) Prior Publication Data

US 2005/0048881 A1 Mar. 3, 2005

(51) Int. Cl.
*B24B 3/46* (2006.01)

(52) U.S. Cl. ..... 451/218; 451/254; 451/293; 76/48

(58) Field of Classification Search ..... 451/254, 451/246, 247, 248, 258, 213, 218, 293; 76/48
See application file for complete search history.

(56) References Cited

U.S. PATENT DOCUMENTS

| | | | | |
|---|---|---|---|---|
| 1,073,487 A | | 9/1913 | Wright | |
| 1,346,004 A | | 7/1920 | Colley | |
| 1,405,454 A | | 2/1922 | Springer | |
| 1,665,954 A | | 4/1928 | Fox | |
| 2,528,193 A | | 10/1950 | Van Allen | |
| 2,618,909 A | * | 11/1952 | Hill | 451/200 |
| 3,766,806 A | * | 10/1973 | Benner | 76/42 |
| 3,986,304 A | | 10/1976 | Shie, III | |
| 4,373,302 A | | 2/1983 | Darby | |
| 4,404,772 A | * | 9/1983 | Snyder | 451/8 |
| 4,766,702 A | * | 8/1988 | Kinner | 451/63 |
| 4,894,391 A | | 1/1990 | Skuballa et al. | |
| 4,984,391 A | | 1/1991 | Sattler | |
| 5,101,704 A | | 4/1992 | Jones et al. | |
| 5,351,578 A | | 10/1994 | Emter | |
| 5,390,431 A | | 2/1995 | Friel | |
| 5,499,943 A | | 3/1996 | Terris | |
| 5,505,107 A | | 4/1996 | Frost | |

* cited by examiner

*Primary Examiner*—Jacob K. Ackun, Jr.
(74) *Attorney, Agent, or Firm*—Dority & Manning, P.A.

(57) ABSTRACT

The present invention relates to an apparatus for sharpening a circular blade. The sharpening apparatus is adapted to be positioned adjacent a power-driven sharpening wheel at an angle. The sharpening apparatus includes an angularly adjustable tool holder for angularly positioning the circular blade against the power-driven sharpening wheel. The sharpening apparatus of the present invention also includes a blade holder that quickly and easily locks the circular blade into place for sharpening and releases the blade after sharpening is complete. The present invention provides a reasonably safe and efficient sharpening apparatus for circular blades that provides uniform, high quality sharpening of one-sided and two-sided blades of varying circumferences.

20 Claims, 13 Drawing Sheets

APPARATUS FOR SHARPENING A CIRCULAR BLADE

FIELD OF THE INVENTION

The present invention generally relates to an apparatus for sharpening a circular blade. More particularly, the invention relates to a sharpening apparatus that includes an adjustable tool holder for angularly positioning the circular blade against a power-driven sharpening wheel and a blade holder that allows for reasonably safe and efficient loading and removal of the circular blade that is being sharpened.

BACKGROUND OF THE INVENTION

Various apparatus for sharpening circular blades are known in the art. For example, U.S. Pat. No. 2,528,193 to Van Allen et al. entitled "Automatic Disk Blade Grinder" discloses a machine for grinding disk-type blades that is adjustable and power-operated for grinding the edge of a disk-type blade to a predetermined bevel and throughout the entire circumference of the blade.

In an apparatus for sharpening a circular blade, the part of the apparatus that holds the circular blade may be angularly adjustable in relation to the sharpening wheel. This is because circular blades having different circumferences require different angular positioning in relation to the power-driven sharpening wheel to ensure uniform sharpening, and a user wants to be able to use the same sharpening apparatus to sharpen circular blades of many different sizes.

Also, a sharpening apparatus for circular blades needs to be safe. A user engaged in blade sharpening attempts to sharpen circular blades as quickly and efficiently as possible, but circular blades are very sharp, requiring the user to take special precautions. Specifically, precautions should be taken when loading the blade onto the sharpening apparatus, when running the power-driven sharpening wheel during sharpening, and when removing the blade from the sharpening apparatus.

Additionally, the moving parts of a circular blade sharpening apparatus should be easy to manipulate so that a user can sharpen circular blades in an efficient manner. For example, if a user wants to sharpen one side of a two-sided circular blade and immediately switch to sharpening the other side of the blade, a sharpening apparatus should be provided with a blade holder or a blade loading and release mechanism that easily enables the user to remove the blade, turn it over, and quickly begin sharpening the second side.

Thus, a need exists in the art for a sharpening apparatus for circular blades wherein the moving parts of the apparatus are easy to manipulate so that the circular blade may be loaded onto and removed from the sharpening apparatus quickly and efficiently. A further need exists for a sharpening apparatus that is safe, where the user's hands and fingers come into contact with the blade as little as possible. The sharpening apparatus of the present invention addresses these and other needs.

SUMMARY OF THE INVENTION

The present invention relates to an apparatus for sharpening a circular blade. The sharpening apparatus includes: a platform and base assembly; a slidable standard that is capable of forward and rearward movement along the platform and base assembly; an adjustable tool holder carried by the slidable standard where the adjustable includes a rotatable shaft supported for rotation and a main body that is angularly adjustable; a blade holder for releasably locking the circular blade onto the apparatus in a plane perpendicular to a longitudinal axis of the rotatable shaft of the tool holder; and a power-driven sharpening wheel.

The sharpening apparatus of the present invention may be used to sharpen both one-sided and two-sided blades. For example, a one-sided circular blade used in a typical pizza cutter may be sharpened using the apparatus of the present invention.

The slidable standard slides along one or more rails mounted on the platform and base assembly. The slidable standard of the apparatus may be driven forward and rearward relative to the power-driven sharpening wheel either manually or mechanically. In embodiments where the slidable standard is mechanically driven toward and away from the power-driven sharpening wheel, the slidable standard may be driven by a motor, by hydraulics, or the slidable standard may be air-driven.

The angular positioning of the adjustable tool holder allows the sharpening apparatus of the present invention to sharpen blades of many different circumferences. While using the apparatus of the present invention for sharpening a circular blade, a handle attached to the rotatable shaft of the adjustable tool holder is turned, either manually or mechanically, to rotate the circular blade and thereby ensure that the entire circumference of the circular blade is sharpened uniformly. In embodiments where the handle attached to the rotatable shaft is turned mechanically during sharpening, a motor may be attached to the handle for turning the handle.

The blade holder of the apparatus present invention may include a threaded blade-centering pin that is used to load and lock the circular blade onto the sharpening apparatus. The blade holder may, alternatively, include a slidable locking cam with an inclined or wedged surface that engages a blade-centering pin and locks the blade-centering pin and the circular blade onto the sharpening apparatus.

The power-driven sharpening wheel employed in the present invention may be, for example, a grinding wheel, a honing wheel, a polishing wheel, a diamond wheel, a leather wheel, an aluminum oxide wheel, a rubber wheel, a composite wheel, or a CBN wheel. In various embodiments of the present invention, a power-driven sharpening wheel may be used that contains two wheels, one on the left side and one on the right side. For example, a power-driven sharpening wheel may be employed where the right wheel is a grinding wheel that creates a larger burr and the left wheel is a grinding wheel that creates a smaller burr, or vice versa. Typically, a "burr" is considered the rough protuberance, ridge, or area left on a metal blade after sharpening. A user of the sharpening apparatus of such embodiments may use the right grinding wheel first to sharpen the chosen blade and obtain a larger burr and then refine the blade using the left grinding wheel that creates a smaller burr.

Generally, the sharpening apparatus of the present invention can be described as comprising: a platform and base assembly; a slidable standard capable of forward and rearward movement along the platform and base assembly; an adjustable tool holder carried by the slidable standard, where the tool holder comprises a rotatable shaft supported for rotation, and a main body that is angularly adjustable; a locking member, where the locking member includes a removable blade-centering pin having an enlarged head on its remote end and a compressible member, and where longitudinal force is applied to the blade-centering pin so that the enlarged head of the blade-centering pin compresses the compressible member against an outer surface of the circular blade for securely holding the circular blade on the adjustable tool holder in a plane perpendicular to a longitudinal axis of the rotatable shaft of the tool holder; and a power-driven sharpening wheel.

BRIEF DESCRIPTION OF THE DRAWINGS

A full and enabling disclosure of this invention, including the best mode known to one of ordinary skill in the art, is set forth in this specification. The following Figures illustrate certain preferred embodiments of the present invention, wherein.

DETAILED DESCRIPTION OF THE INVENTION

Reference now will be made to various embodiments of the present invention. Each embodiment is provided by way of explanation of the invention, not as a limitation of the invention. In fact, it will be apparent to those skilled in the art that various modifications and variations can be made in this invention without departing from the scope or spirit of the invention.

Figure 1:
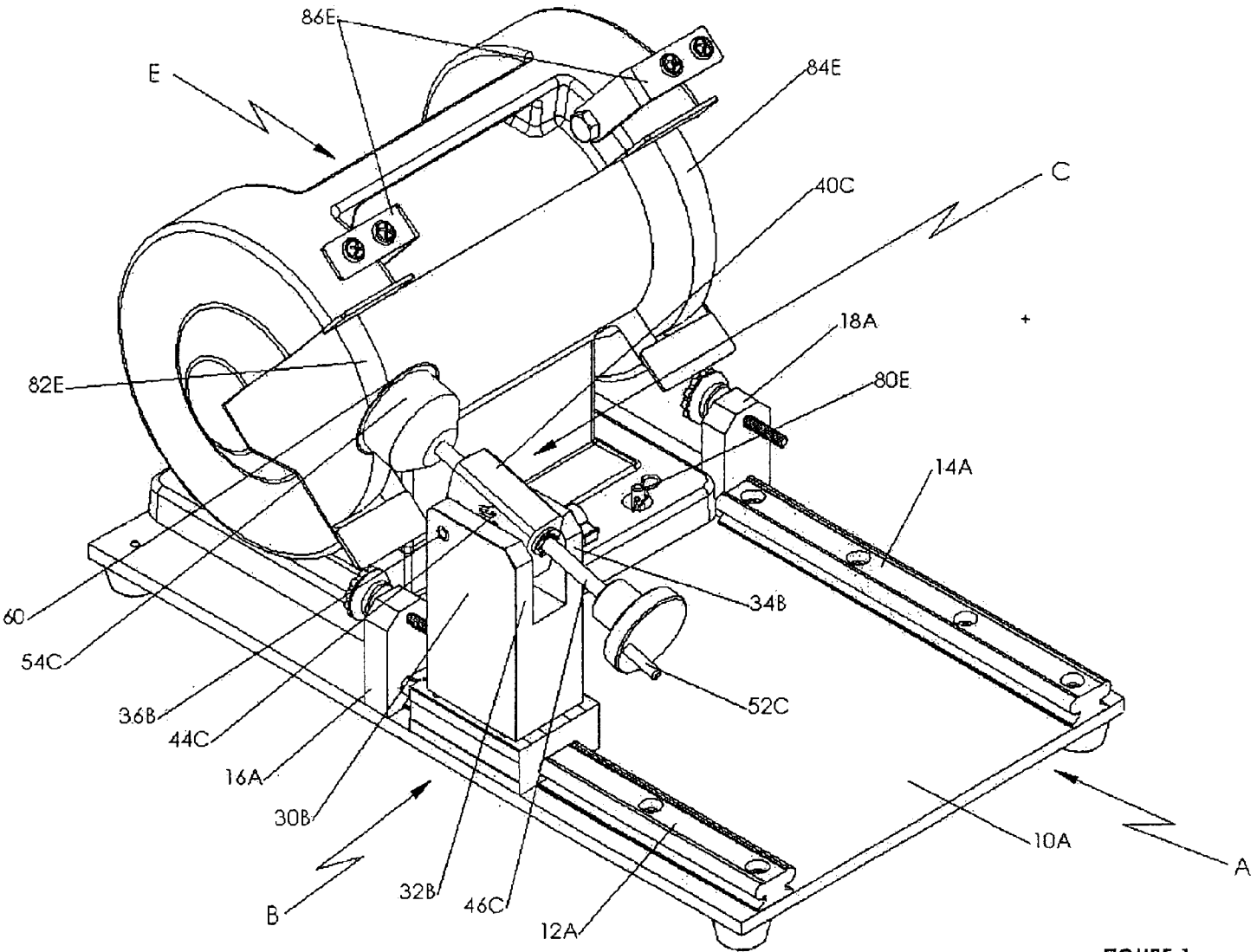
FIG. 1 shows a left, front perspective view of a sharpening apparatus in accordance with a preferred embodiment of the present invention.

FIG. 1 shows a first preferred embodiment of a sharpening apparatus in accordance with the present invention. The sharpening apparatus of FIG. 1 includes a platform and base assembly A. Specifically, platform and base assembly A is provided with: a platform 1OA, which may be flat; left rail 12A and right rail 14A, which extend lengthwise along the left and right sides of platform 10A; and left stop 16A and right stop 18A. Platform 10A, rails 12A and 14A, and stops 16A and 18A may be constructed out various materials including metals and plastics. More specifically, the parts of platform and base assembly A may be constructed of aluminum, bronze, brass, graphite, a rigid plastic, or the like.

Figure 2:
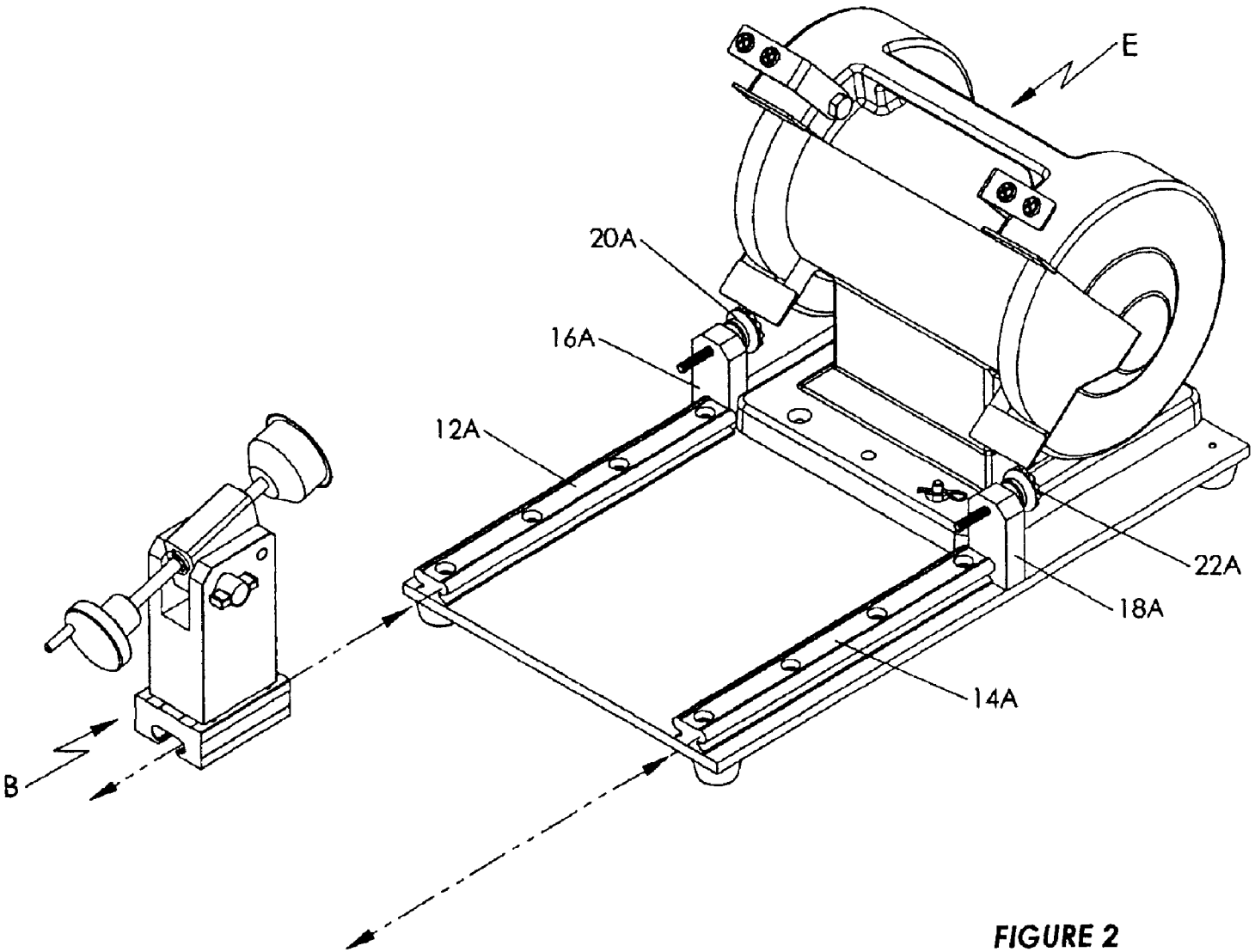
FIG. 2 shows a right, front perspective view of the sharpening apparatus of FIG. 1, where the slidable standard is shown being loaded and unloaded from the platform and base assembly of the apparatus.

The sharpening apparatus of FIG. 1 further includes slidable standard B. The bottom portion of slidable standard B comprises a bearing. This bearing is configured so that slidable standard B can be loaded and unloaded, from the rear of platform 10A, onto either of left rail 12A or right rail 14A and so that slidable standard B is able to slide along either rail 12A or 14A. For example, as shown in FIG. 2, the bottom portion of slidable standard B comprises a bearing having a modified "C-shape" that complements the modified "C-shape" of left rail 12A and right rail 14A. The arrows of motion in FIG. 2 show how slidable standard B may be loaded or unloaded onto left rail 12A or right rail 14A.

It should be noted that even though FIGS. 1 and 2 depict a slidable standard having a bearing with a modified "C-shape," the bearing of the bottom portion of slidable standard B can be any linear bearing, including but not limited to, a round rail bearing, a square rail bearing, a wheel and channel bearing, a dovetail bearing, or a gothic arch bearing. Likewise, the left and right rails of platform and base assembly A can be any linear rail, including but not limited to, a round rail, a square rail, a wheel and channel-type rail, a dovetail-type rail, or a gothic arch rail.

As seen in FIG. 2, left stopping screw 20A, which is threaded through left stop 16A, will serve to stop slidable standard B from sliding too far along left rail 12A into the power-driven sharpening wheel E. Similarly, if slidable standard B were being loaded onto right rail 14A, right stopping screw 22A, which is threaded through right stop 18A, would serve to stop slidable standard B from sliding too far along right rail 14A into power-driven sharpening wheel E.

Referring back to FIG. 1, slidable standard B may include, in certain embodiments, a bifurcated upper portion 30B that provides a space between two vertically extending legs 32B and 34B. This bifurcated upper portion 30B may also be described as yoke-shaped or y-shaped. In FIG. 1, the space that is provided between vertically extending legs 32B and 34B of bifurcated upper portion 30B of slidable standard B houses an adjustable tool holder C. Specifically, adjustable tool holder C has a main body 40C that fits into the space between vertically extending legs 32B and 34B. Main body 40C of adjustable tool holder C is permanently secured in the space between vertically extending legs 32B and 34B by a pin that extends through hole 36B (shown on leg 32B), through main body 40C, and through a hole (not shown in FIG. 1) on leg 34B that is the mirror image of hole 36B.

Figure 3:
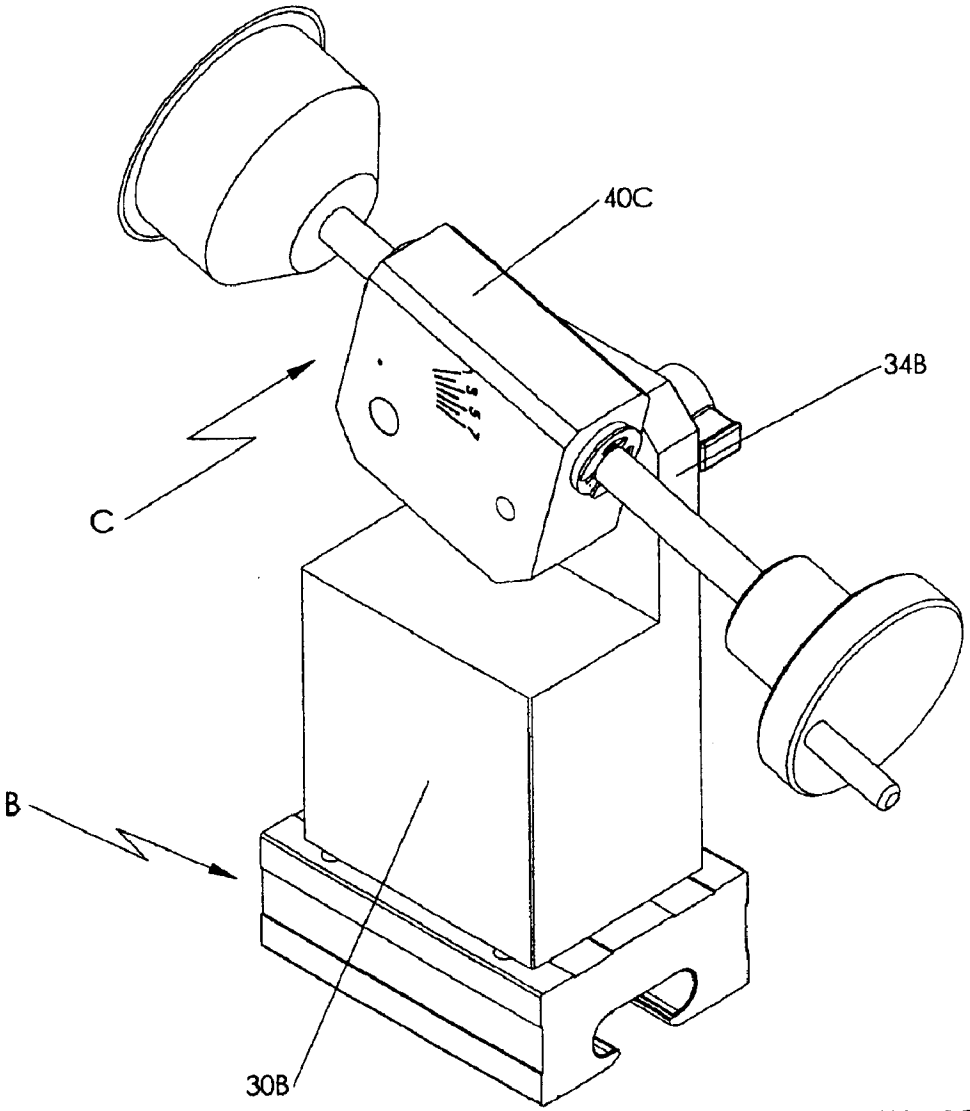
FIG. 3 shows a left, side view of the slidable standard and the adjustable tool holder of an alternative embodiment of a sharpening apparatus of the present invention.

It should be noted that in certain embodiments of the present invention, the upper portion of slidable standard B is not bifurcated. For example, as shown in FIG. 3, main body 40C of adjustable tool holder C may be permanently secured in a space beside one vertically extending leg 34B of upper portion 30B of slidable standard B by a pin that extends through main body 40C and through leg 34B.

Figure 4:
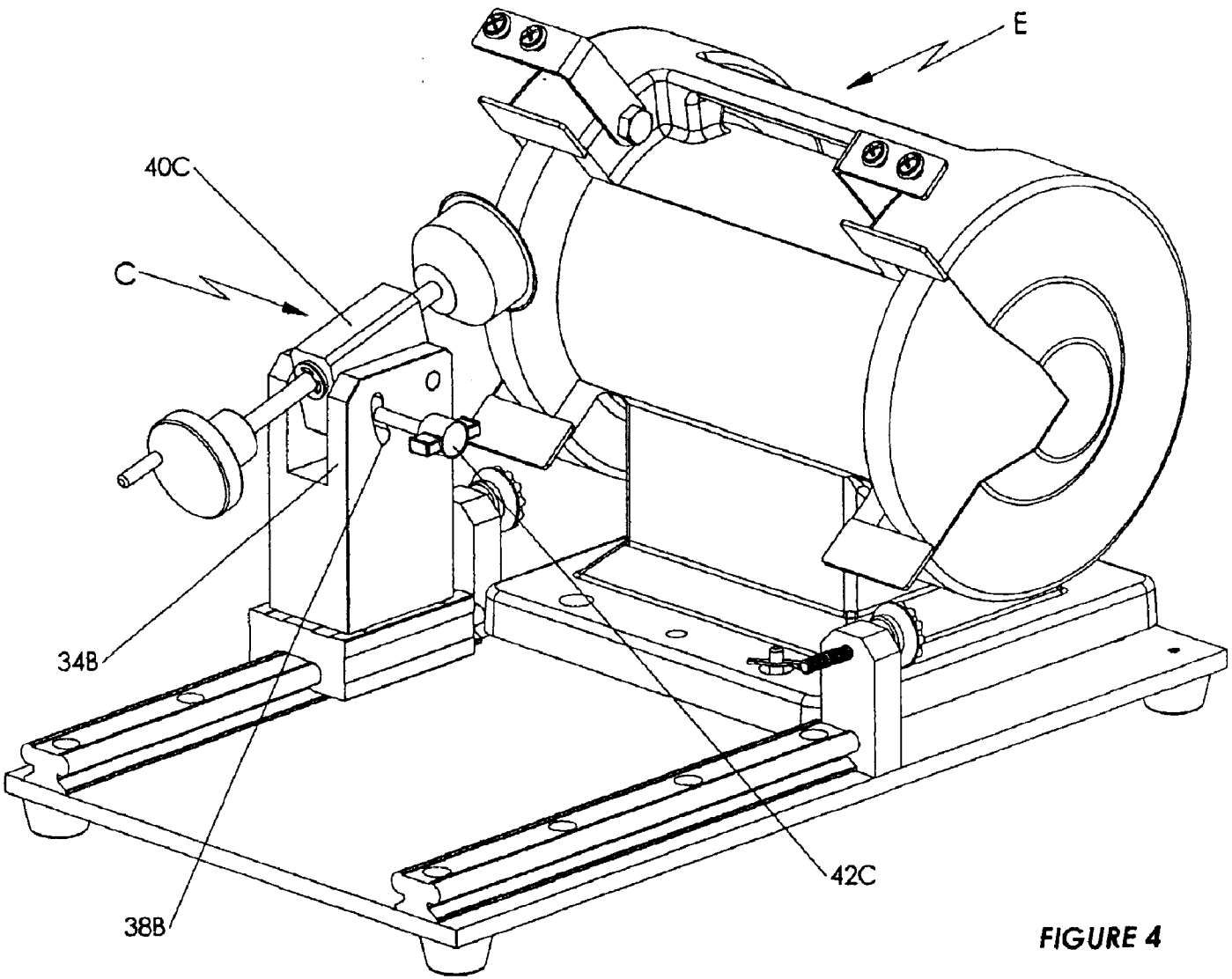
FIG. 4 shows a right, front perspective view of the sharpening apparatus of FIG. 1.

Referring to FIG. 4, main body 40C of adjustable tool holder C may be angularly positioned relative to power-driven sharpening wheel E by pivoting through a range of motion established by hole 38B on leg 34B. Specifically, knob 42C is attached to a screw that extends through hole 38B and into a threaded hole running through main body 40C. Knob 42C is loosened to allow main body 40C to be angularly positioned relative to power-driven sharpening wheel E, through upward and downward movement, depending on the circumference of the circular blade to be sharpened. Knob 42C is tightened to secure main body 40C in the desired angular position.

In certain preferred embodiments of the present invention, guide marks 44C are provided on main body 40C of adjustable tool holder C, as shown in FIG. 1. For example, such guide marks 44C may be added to main body 40C by laser inscribing or the like. In such embodiments, the guide marks aid the user in angularly positioning main body 40C so that a specific angle (for example, a 30° angle) is established for main body 40C of adjustable tool holder C relative to power-driven sharpening wheel E, depending on the diameter of the circular blade to be sharpened.

Figure 5:
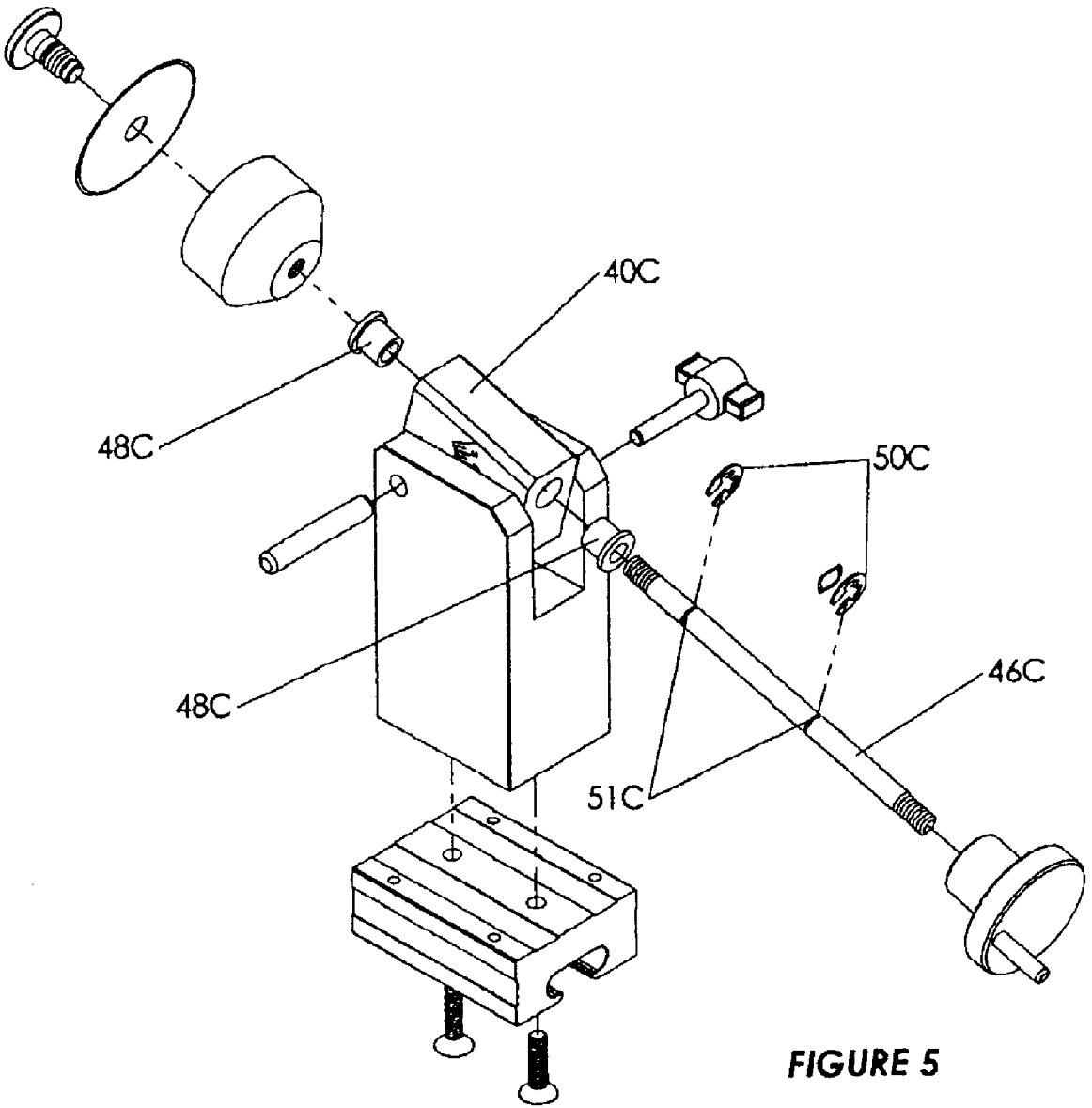
FIG. 5 shows a left, side, exploded view of parts of the slidable standard, the adjustable tool holder, and the blade holder of the sharpening apparatus of FIG. 1.

Still looking to FIG. 1, main body 40C of adjustable tool holder C contains a bore that extends longitudinally through main body 40C. This bore allows rotatable shaft 46C to extend through main body 40C of adjustable tool holder C. FIG. 5 provides an exploded view of some of the parts of the sharpening apparatus of the embodiment of FIG. 1, particularly slidable standard B and adjustable tool holder C. Specifically FIG. 5 shows the combination of bushings 48C and retaining rings 50C that ensures that rotatable shaft 46C does not move forwards or backwards inside the bore of main body 40C. This combination of bushings 48C and retaining rings 50C also allows shaft 46C to rotate freely within the bore of main body 40C. Specifically, retaining rings 50C fit into grooves 51C on rotatable shaft 46C to prevent forwards and backwards movement of rotatable shaft 46C inside the bore of main body 40C. It should be noted that in other embodiments of the present invention, snap rings are used in place of retaining rings 50C, and in such embodiments, there is no need for rotatable shaft 46C to contain grooves 51C.

Referring back to FIG. 1, rotatable shaft 46C of adjustable tool holder C is rotated using handle 52C. Specifically, in preferred embodiments of the present invention, a user will turn handle 52C clockwise throughout the entire time of blade sharpening to rotate shaft 46C which in turn rotates the circular blade being sharpened and allows for uniform sharpening of the entire circumference of the circular blade. It should be noted that in certain embodiments of the present invention, handle 52C is rotated manually by a user, while in other embodiments, handle 52C is rotated mechanically, for example, by a motor.

The top of shaft 46C of adjustable tool holder C is affixed to a blade-receiving member 54C. This blade-receiving member 54C may be generally cylindrical in shape with its bottom or rear portion having a reduced diameter as shown in FIG. 1. A smooth, flat surface of blade-receiving member 54C is where the circular blade 60 to be sharpened will be loaded for sharpening. For example, the enlarged view shown in FIG. 6 illustrates the smooth, flat surface 56C of blade-receiving member 54C where circular blade 60 to be sharpened will be loaded for sharpening.

Another facet of the sharpening apparatus of the present invention is blade holder D. Referring to FIG. 6, in certain preferred embodiments, blade holder D may be a removable, blade-centering pin that includes: a head 7OD; a shoulder 72D, where the diameter of shoulder 72D corresponds to or fits the inside diameter (I.D.) of circular blade 60 to be sharpened; and a threaded portion 74D. In some preferred embodiments, the center portion of head 70D of blade holder D may be color coded to match some identifying color located on circular blade 60 to be sharpened or on the packaging of such circular blade 60. This color coordination scheme allows a user to ensure quickly and easily that the correct sized blade holder is being used with the particular circular blade to be sharpened.

Figure 6:
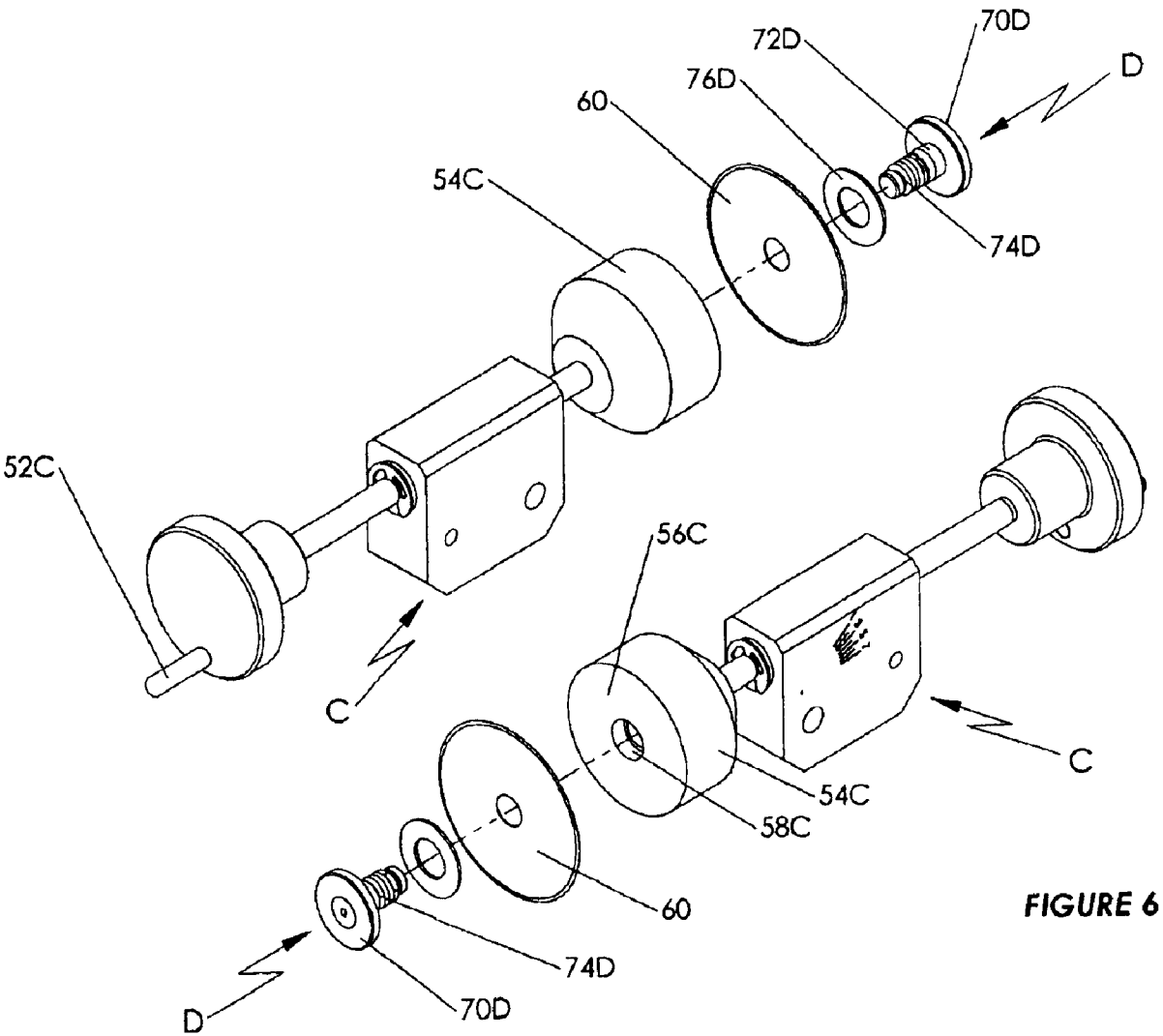
FIG. 6 shows two enlarged views of the blade holder, the circular blade to be sharpened, and the adjustable tool holder of the sharpening apparatus of FIG. 1.

Still looking to FIG. 6, when loading circular blade 60 onto a sharpening apparatus in accordance with the present embodiment, the user can allow blade 60 to rest on shoulder 72D of blade holder D while inserting threaded portion 74D of blade holder D into hole 58C that extends inside blade-receiving member 54C. As seen in FIG. 6, hole 58C is partially threaded to receive threaded portion 74D of blade holder D.

In certain preferred embodiments, a standard fiber washer 76D is provided as part of blade holder D. In such embodiments, standard fiber washer 76D rests on shoulder 72D of blade holder D, between the underside of head 70D and circular blade 60 to supply proper friction or tension to blade 60 while sharpening and thereby prevent blade 60 from slipping while sharpening. It should be noted that instead of standard fiber washer 76D, a rubber gasket, a lock washer, a foam washer, or the like could be used to provide friction and prevent blade 60 from slipping while sharpening.

As threaded portion 74D of blade holder D is inserted into hole 58C, the user holds head 70D steady with one hand (for example, with the user's left hand) while turning handle 52C clockwise (for example, with the user's right hand) until circular blade 60 rests against smooth, flat surface 56C of blade-receiving member 54C and the fit is hand-tight.

Thus, to summarize the above-described embodiment of the present invention with reference to FIGS. 1 and 6, a sharpening apparatus is shown where a user loads circular blade 60 onto blade-receiving member 54C of adjustable tool holder C and locks circular blade 60 into place using blade holder D. Adjustable tool holder C is held by slidable standard B, which slides forward and rearward along either of rails 12A or 14A affixed to platform and base assembly A. Once the combination of slidable standard B, adjustable tool holder C, circular blade 60, and blade holder D slides toward power-driven sharpening wheel E and once circular blade 60 is angularly positioned relative to power-driven sharpening wheel E, circular blade 60 is ready to be sharpened.

Looking back to FIG. 1, power-driven sharpening wheel E is provided for sharpening the circular blade, and wheel E and sits upon platform 10A. In certain preferred embodiments, sharpening wheel E is secured to platform 10A by locating pins (for example, 80E). As mentioned above, power-driven sharpening wheel E comes into contact with circular blade 60 by way of the forward sliding movement of slidable standard B and by way of the angular positioning of adjustable tool holder C.

Figure 7:
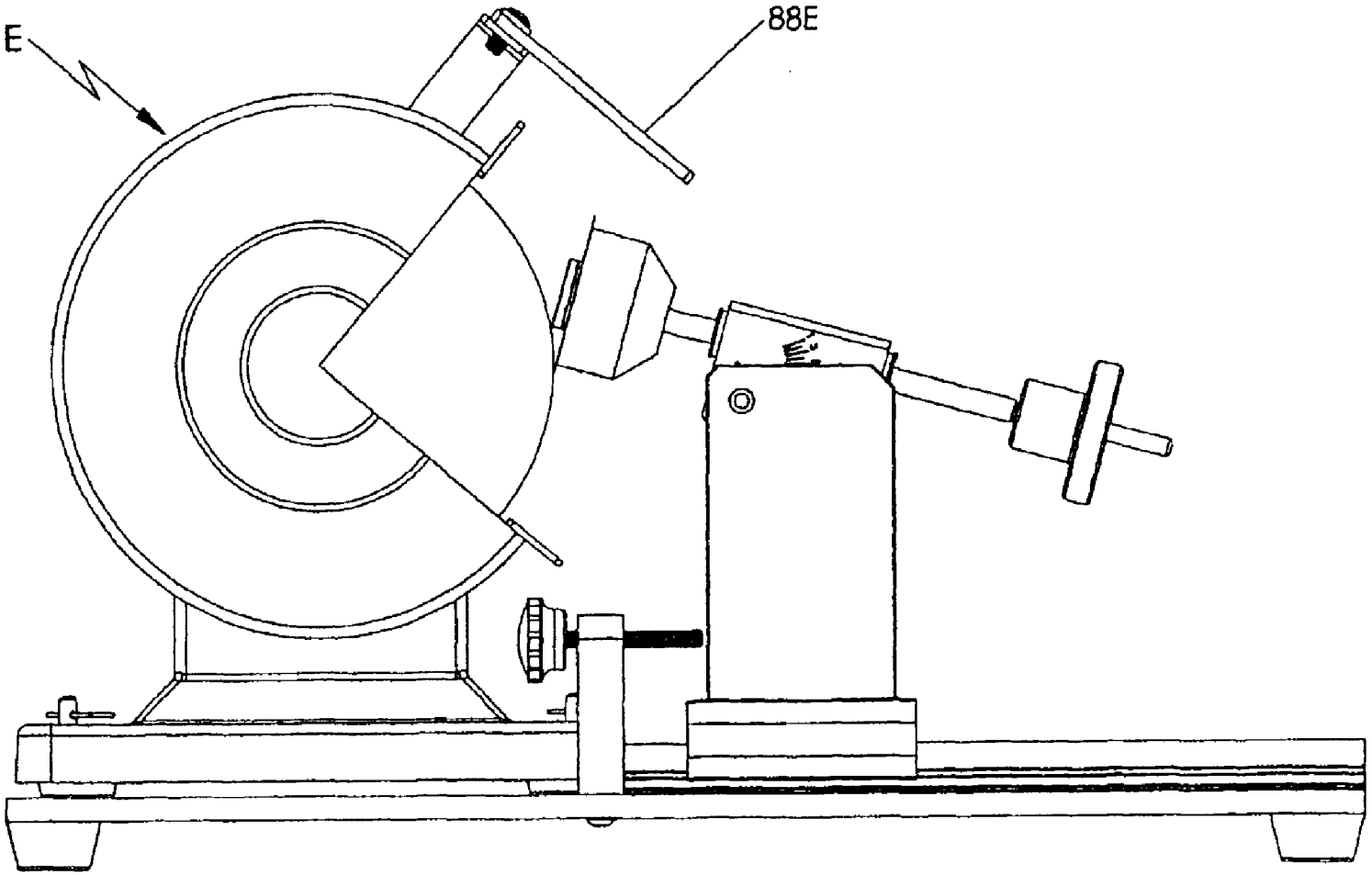
FIG. 7 shows a left, side view of a sharpening apparatus in accordance with a preferred embodiment of the present invention, where the power-driven sharpening wheel is provided with a safety eyeshield.

In certain preferred embodiments, power-driven sharpening wheel E may be provided with two wheels for working with circular blade 60. For example, in FIG. 1, power-driven sharpening wheel E is shown as having left wheel 82E, which might be a grinding wheel, as well as right wheel 84E, which might be a finishing or polishing wheel. Additionally, in certain preferred embodiments, power-driven sharpening wheel E may be provided with certain safety features, such as an eyeshield 88E, as shown in FIG. 7, a left side view of a sharpening apparatus in accordance with certain preferred embodiments of the present invention. Eyeshield 88E protects the user's eyes while sharpening circular blades. Two mounting areas 86E are shown in FIG. 1 for mounting such an eyeshield.

Figure 8:
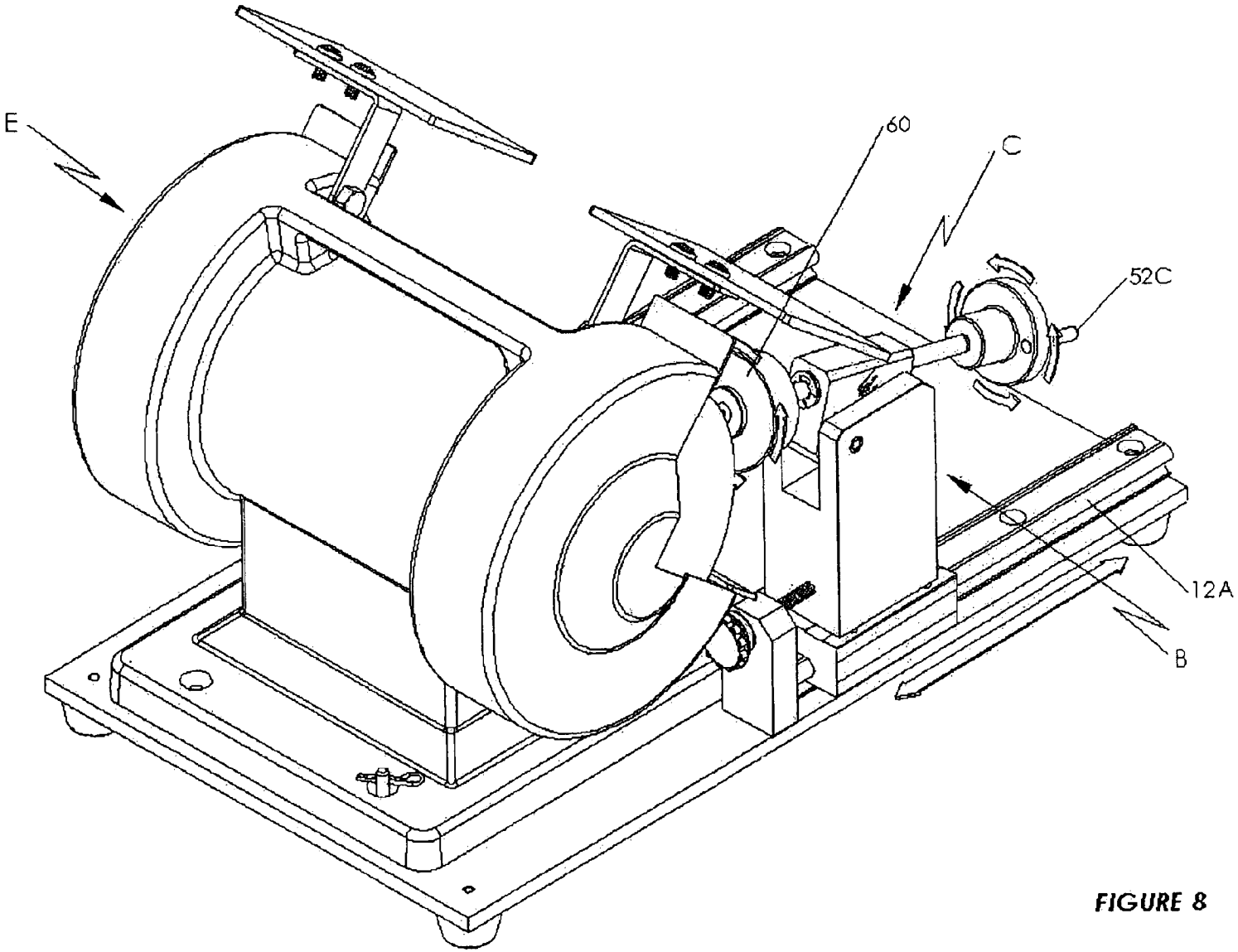
FIG. 8 shows a left, rear perspective view of the sharpening apparatus of FIG. 1 in motion.

Looking to FIG. 8, there is shown a left rear perspective view of a sharpening apparatus in accordance with the embodiment of the present invention depicted in FIG. 1. FIG. 8 includes arrows of motion which represent the clockwise rotation of handle 52C, which causes the rotation of circular blade 60. As stated above, the constant rotation of circular blade 60 (caused by the constant rotation of handle 52C either manually or mechanically) while sharpening helps to ensure that the entire circumference of circular blade 60 will be sharpened uniformly. Note that during sharpening, a user might firmly hold slidable standard B steady in a forward direction to ensure that slidable standard B does not travel rearward along left rail 12A.

Thus, referring to FIG. 8 (but also generally) a user may turn on power-driven sharpening wheel E, angularly position adjustable tool holder C according to the size of circular blade 60 to be sharpened, slide the slidable standard B toward power-driven sharpening wheel E, allow circular blade 60 to come into contact with power-driven sharpening wheel E for sharpening, and immediately begin turning handle 52C to ensure uniform sharpening all the way around the circumference of circular blade 60.

Figure 9:
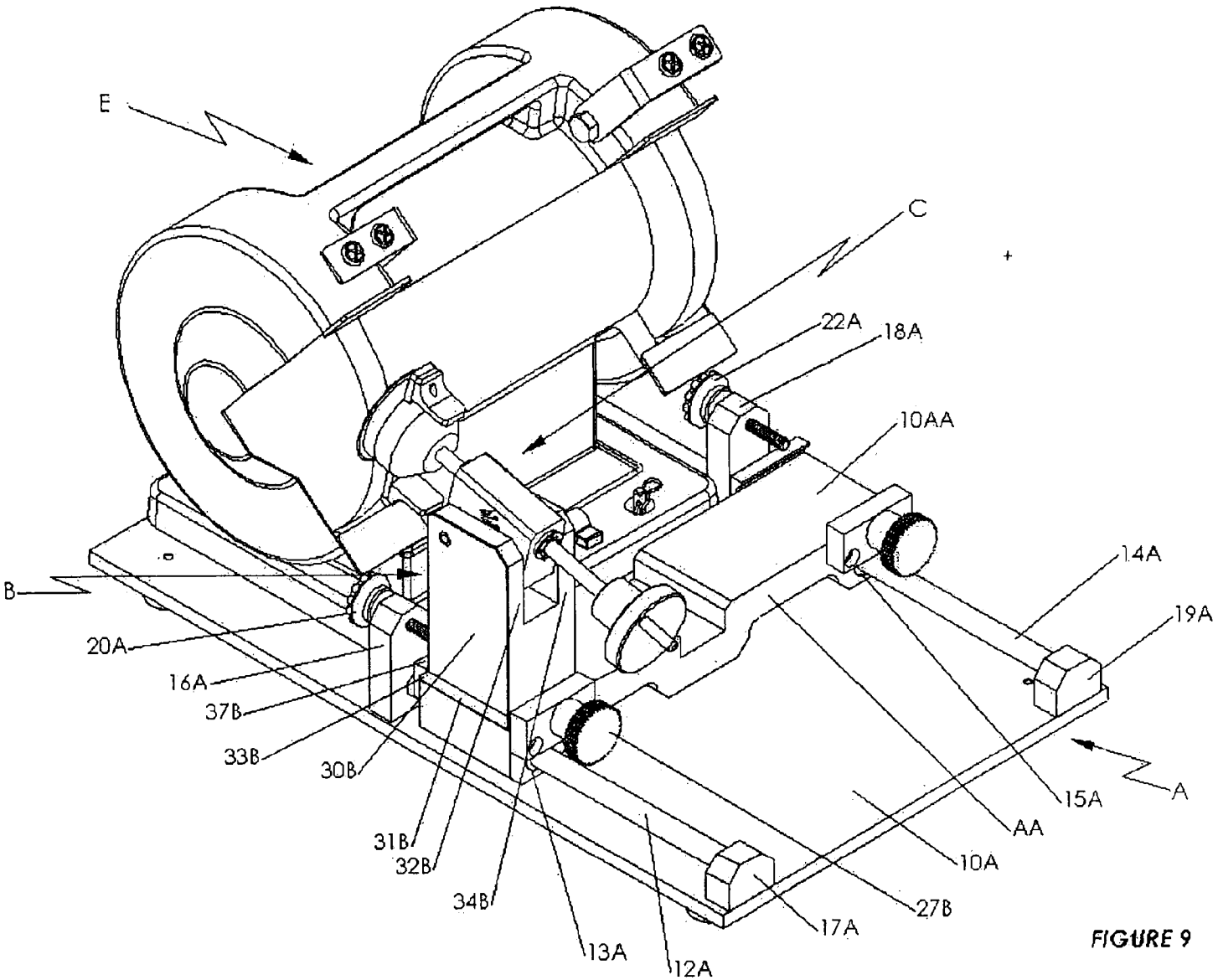
FIG. 9 shows a left, front perspective view of a sharpening apparatus in accordance with an alternative preferred embodiment of the present invention.

FIG. 9 shows an alternative preferred embodiment of a sharpening apparatus in accordance with the present invention. Like the sharpening apparatus shown in FIG. 1, the sharpening apparatus of FIG. 9 also includes a platform and base assembly A, where assembly A is provided with platform 10A, left rail 12A, right rail 14A, left stop 16A, right stop 18A, left stopping screw 20A, and right stopping screw 22A. Platform and base assembly A of the apparatus depicted in FIG. 9 also includes left rear stop 17A, and right rear stop 19A.

Furthermore, platform and base assembly A includes a horizontally extending slidable base AA. Slidable base AA slides along left and right rails 12A and 14A, and bearings 13A and 15A are provided for base AA so that it slides easily along rails 12A and 14A. Left rear stop 17A and right rear stop 19A mounted on platform 10A limit the rearward movement of slidable base AA.

The sharpening apparatus depicted in FIG. 9 also includes a standard B. In certain embodiments, standard B has a bifurcated upper portion 30B, which provides a space between two vertically extending legs 32B and 34B that houses adjustable tool holder C. However, in other embodiments, the upper portion of standard B is not bifurcated (as depicted with regard to a previous embodiment in FIG. 3).

Figure 10:
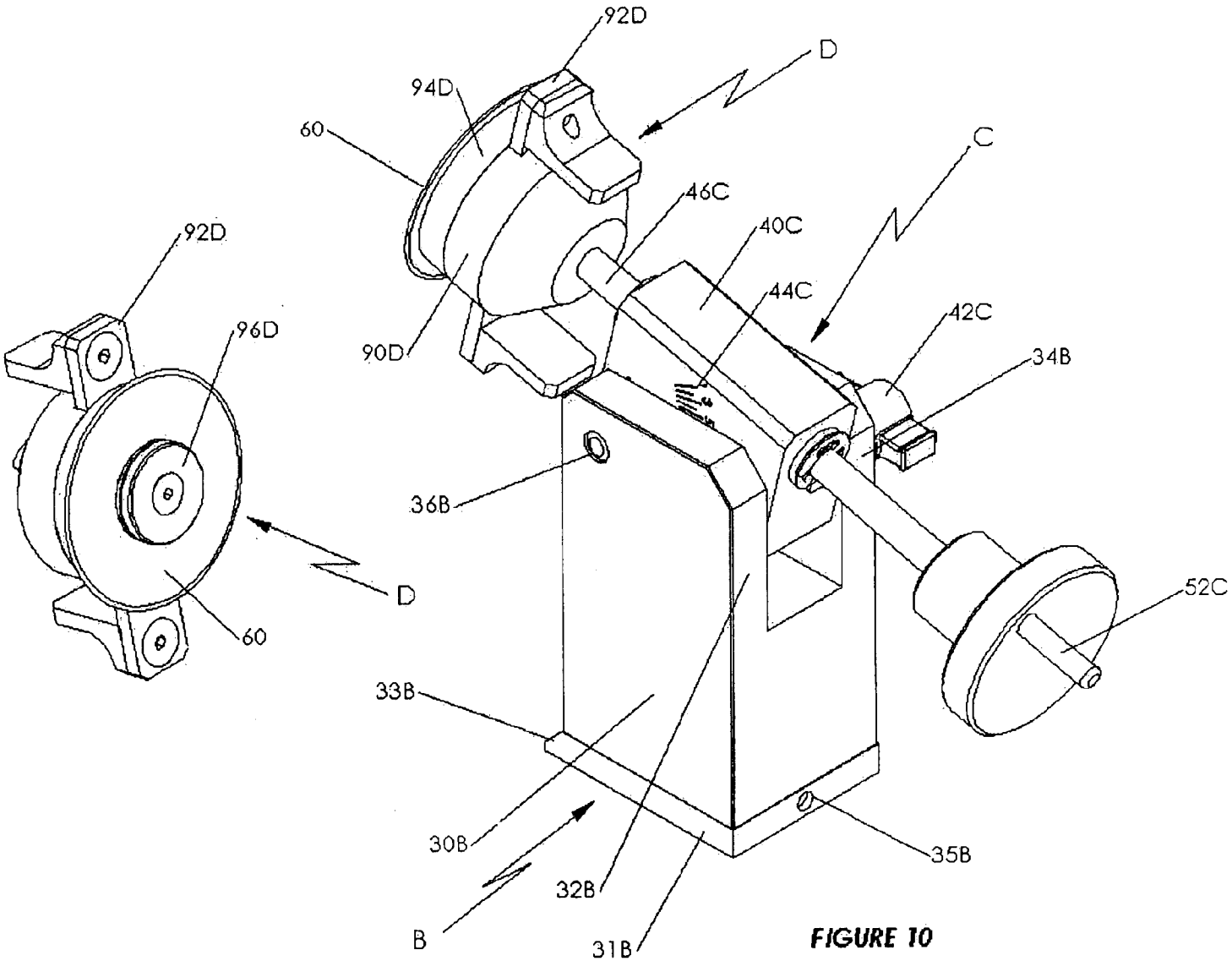
FIG. 10 shows a left, side, enlarged view of the standard, the adjustable tool holder, and the blade holder of the sharpening apparatus of FIG. 9, along with an inset enlarged view of the blade holder of the sharpening apparatus of FIG. 9.

Looking to FIG. 10, an enlarged view of standard B is included, where standard B has a base 31B that includes an extended lip 33B and a receiving hole 35B. Base 31B of standard B, with its extended lip 33B and receiving hole 35B, allows standard B to be secured on either of two mounting areas of slidable base AA. For example, referring back to FIG. 9. standard B is shown mounted on a left mounting area of slidable base AA, while right mounting area 10AA is left open. Specifically in FIG. 9, standard B has been placed on the left mounting area of slidable base AA with its extended lip 33B fitting securely under a left lip receiver 37B. Once extended lip 33B is fit under left lip receiver 37B, a left knob 27B is tightened so that a screw fits snugly into the receiving hole located at the back of base 31B of standard B.

Figure 11:
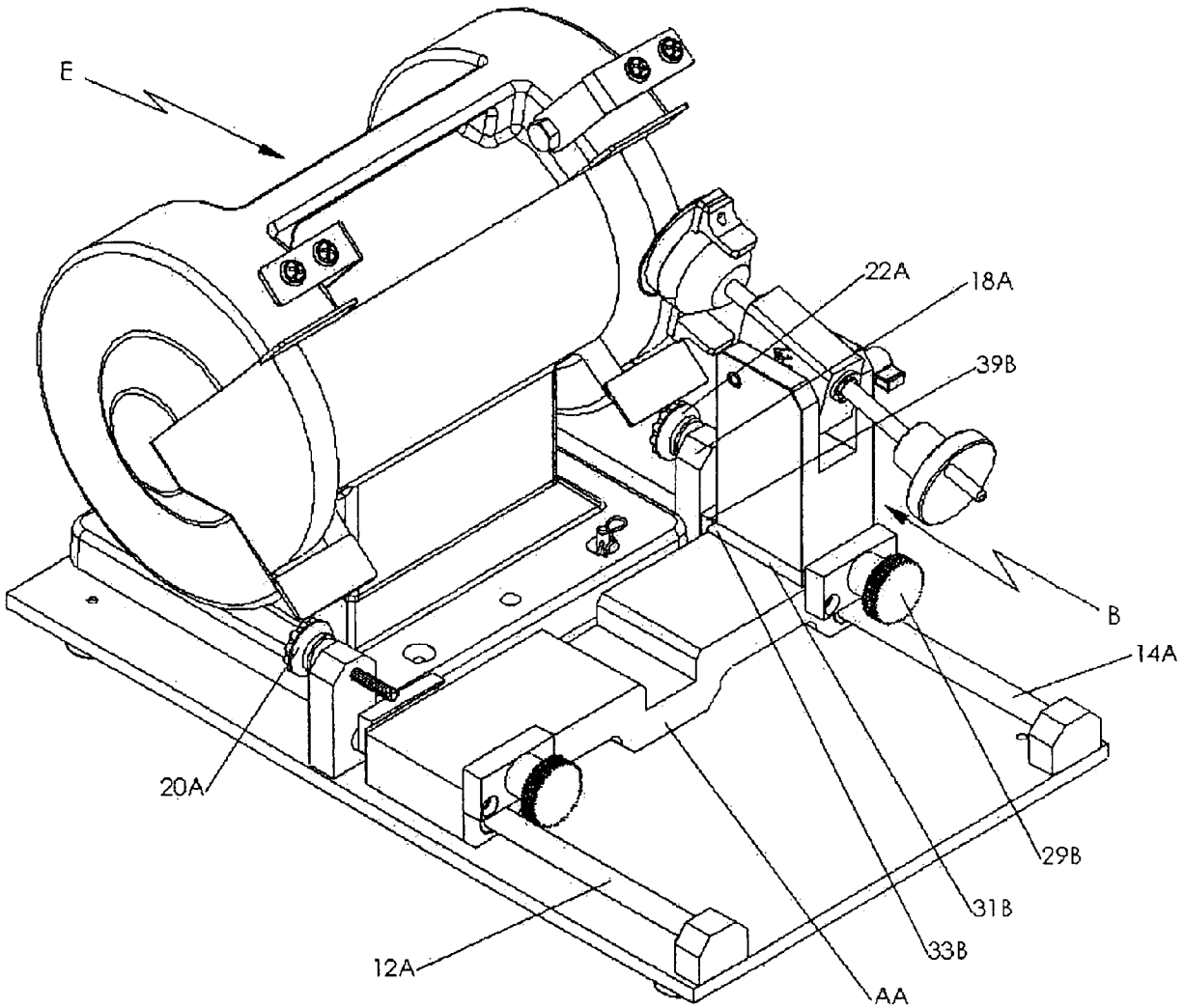
FIG. 11 shows a left, front perspective view of the sharpening apparatus of FIG. 9, where the standard is mounted on the right mounting area of the horizontally extending slidable base of the platform and base assembly.

FIG. 11 shows an alternative embodiment of the sharpening apparatus of FIG. 9, where standard B is mounted on the right mounting area of slidable base AA. In FIG. 11, standard B has been placed on the right mounting area of slidable base AA with its extended lip 33B fitting securely under a right lip receiver 39B. As extended lip 33B of standard B is fit under right lip receiver 39B, right knob 29B is tightened so that a screw fits snugly into the receiving hole located at the back of base 31B of standard B.

FIG. 9 shows left stopping screw 20A, which is threaded through left stop 16A, and which will serve to stop the combination of standard B and slidable base AA from sliding too far along rails 12A and 14A into the power-driven sharpening wheel E when standard B is mounted on the left mounting area of slidable base AA. Similarly, as shown in FIG. 11, if standard B is mounted on the right mounting area of slidable base AA, right stopping screw 22A, which is threaded through right stop 18A, will serve to stop the combination of standard B and slidable base AA from sliding too far along rails 12A and 14A into power-driven sharpening wheel E.

Returning to FIG. 10, the space that is provided between vertically extending legs 32B and 34B of bifurcated upper portion 30B of standard B houses adjustable tool holder C. Just as described in detail above with regard to previous embodiments, adjustable tool holder C has a main body 40C that fits into the space between vertically extending legs 32B and 34B. Also, as described above, main body 40C of adjustable tool holder C is permanently secured in the space between vertically extending legs 32B and 34B by a pin that extends through hole 36B (shown on leg 32B), through main body 40C, and through a hole (not shown in FIG. 10) on leg 34B that is the mirror image of hole 36B. Main body 40C may be angularly positioned relative to power-driven sharpening wheel E by loosening and tightening knob 42C as described in detail above. In the present embodiment, guide marks 44C may be provided on main body 40C of adjustable tool holder C to aid a user in angularly positioning main body 40C at a specific angle, depending on the diameter of the circular blade to be sharpened.

Like the embodiments of the present invention shown in FIG. 1 and described above, FIG. 10 shows that main body 40C of adjustable tool holder C contains a bore that extends longitudinally through main body 40C and that allows rotatable shaft 46C to extend through main body 40C. In the embodiment of FIG. 10, a combination of bushings and retaining rings ensures that rotatable shaft 46C cannot move forwards or backwards inside the bore of main body 40C and allows shaft 46C to rotate freely within the bore of main body 40C.

During sharpening, a user will turn handle 52C to rotate shaft 46C and thereby allow for uniform sharpening of the entire circumference of the circular blade beirig sharpened. In some preferred embodiments, handle 52C is rotated manually by a user during sharpening, while in other embodiments, handle 52C is rotated mechanically.

Still looking to FIG. 10, the top of shaft 46C of adjustable tool holder C is affixed to blade holder D, a blade holder that differs from the blade holder described above with regard to the embodiments of the present invention depicted by FIGS. 1–8. Generally, blade holder D of FIG. 10 includes a slidable locking cam 92D that allows for efficient loading and removal of the circular blade 60 to be sharpened. The major components of blade holder D, as shown in FIG. 10 and its inset, include: a cam guide disc 90D; a slidable locking cam 92D; a retaining disc 94D; and a removable blade-centering pin 96D, all of which work together to hold circular blade 60 in place on the apparatus while sharpening.

Figure 12:
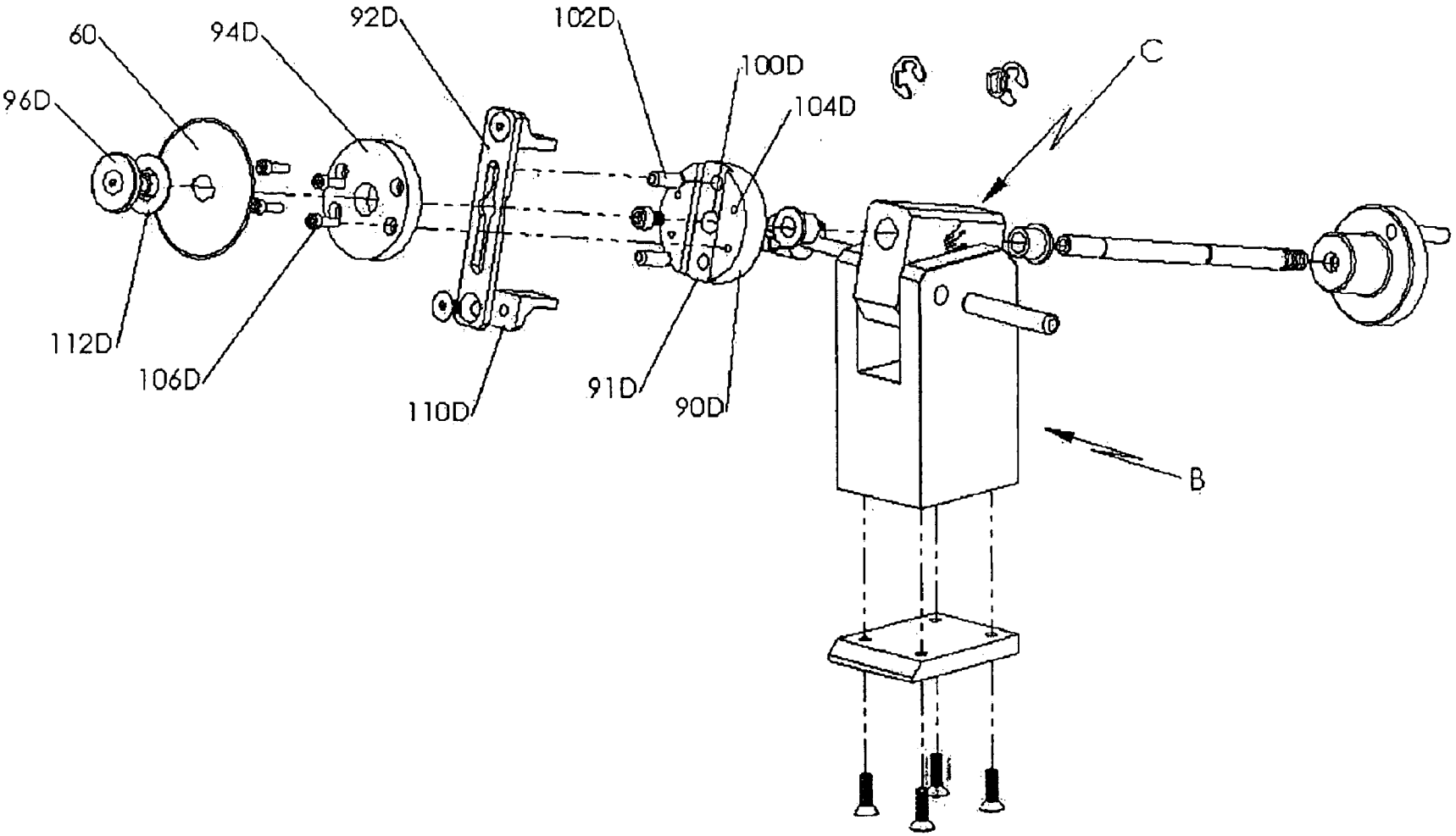
FIG. 12 shows a left, side, exploded view of parts of the standard, the adjustable tool holder, and the blade holder of the sharpening apparatus of FIG. 9.

Looking to FIG. 12, there is shown an exploded view of parts of standard B, adjustable tool holder C, and blade holder D. With regard to the parts of blade holder D, cam guide disc 90D contains a slot 91D for receiving slidable locking cam 92D. Slot 91D on cam guide disc 90D contains center hole 100D as well as two locating pins 102D. Locating pins 102D create a sideways range of motion through which slidable locking cam 92D moves from an unlocked position to a locked position (described in more detail below). Cam guide disc 90D is also provided with holes 104D to receive the screws used to secure retaining disc 94D and slidable locking cam 92D to cam guide disc 90D.

Still looking to FIG. 12, slidable locking cam 92D is placed into slot 91D of cam guide disc 90D using locating pins 102D as a guide. Slidable locking cam 92D is secured to the blade holder assembly by retaining disc 94D and socket head screws 106D that permanently fasten retaining disc 94D to cam guide disc 90D via holes 104D.

Circular blade 60 may then be loaded onto removable blade-centering pin 96D. A compressible washer 112D may rest on the shoulder of blade-centering pin 96D to supply friction or tension between circular blade 60 and the underside of the head of blade-centering pin 96D, thereby preventing circular blade 60 from slipping during sharpening. Compressible washer 112D may be made of a rubberized material or the like.

The combination of blade-centering pin 96D, compressible washer 112D, and circular blade 60 is then loaded onto the sharpening apparatus. Specifically, removable blade-centering pin 96D is inserted through the center hole of retaining disc 94D, through a circular hole in slidable locking cam 92D and into center hole 100D of cam guide disc 90D. This constitutes an unlocked position for circular blade 60 on the sharpening apparatus of the present embodiment.

Figure 13B:
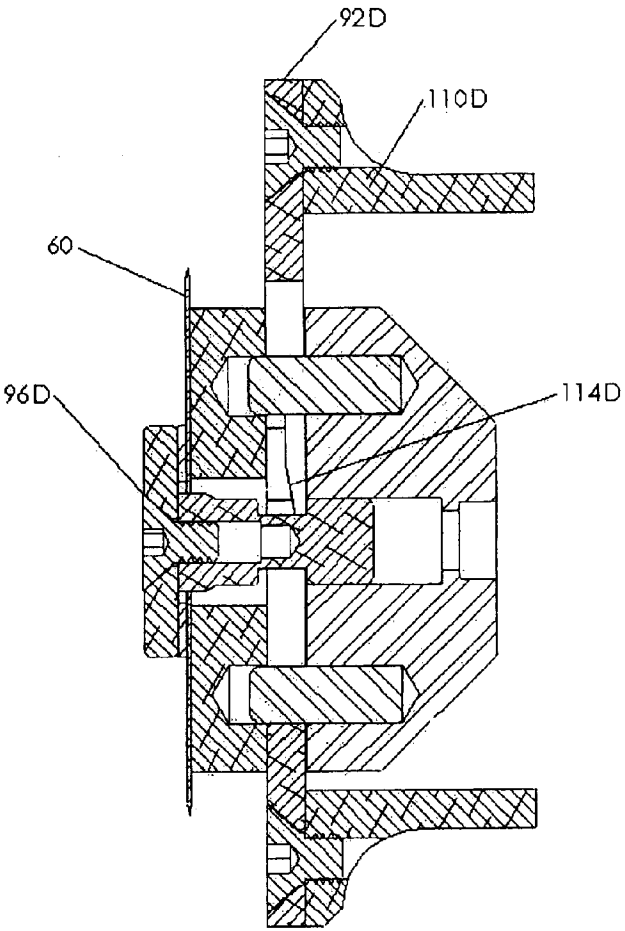
FIG. 13B shows a cross-sectional view of the parts of the blade holder of the sharpening apparatus of FIG. 9, where the blade holder is in a locked position.
Figure 13A:
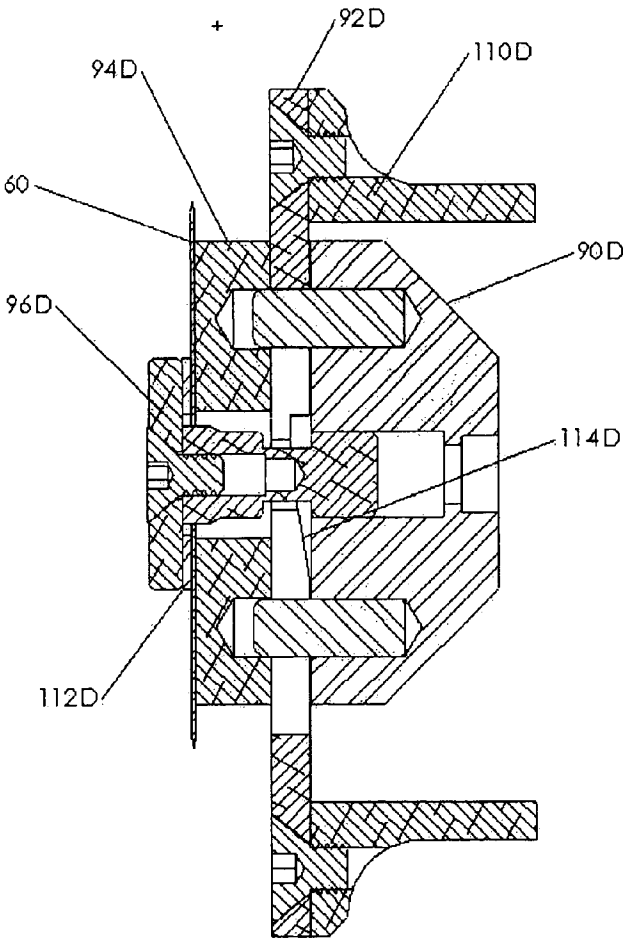
FIG. 13A shows a cross-sectional view of the parts of the blade holder of the sharpening apparatus of FIG. 9, where the blade holder is in an unlocked position.

FIGS. 13A and 13B are included to provide more detail on how slidable locking cam 92D is used to hold circular blade 60 in a locked position on the sharpening apparatus. Specifically, FIG. 13A depicts the unlocked position, described above, wherein the combination of blade-centering pin 96D, compressible washer 112D, and circular blade 60 has been loaded onto the sharpening apparatus by inserting removable blade-centering pin 96D through the center hole of retaining disc 94D, through the circular hole in slidable locking cam 92D and into the center hole of cam guide disc 90D.

As shown in FIG. 13A, slidable locking cam 92D includes a rear inclined surface 114D as well as two flanges 110D that allow a user to grasp slidable locking cam 92D and slide it from the unlocked to a locked position (and vice versa). As a user grasps flanges 110D of slidable locking cam 92D and slides cam 92D upward, rear inclined surface 114D of slidable locking cam 92D engages a portion of blade-centering pin 96D, pulling blade-centering pin 96D rearward and locking blade-centering pin 96D into the locked position shown in FIG. 13B. In the locked position, slidable locking cam 92D retains the rear portion of blade-centering pin 96D, thereby securing blade 60 to the apparatus for sharpening. A safety feature of the apparatus of the present embodiment involves flanges 110D of slidable locking cam 92D being positioned so that they extend away from circular blade 60 rather than toward circular blade 60.

In other embodiments of the present invention, a sharpening apparatus is provided where the forward and rearward movement of the circular blade to be sharpened, toward and away from the power-driven sharpening wheel, is accomplished by the forward and rearward movement of the rotatable shaft through the bore inside the main body of the adjustable tool holder. For example, in FIG. 1, rather than slidable standard B moving forward and rearward, toward and away from power-driven sharpening wheel E, slidable standard B would be held stationary on either left rail 12A or 14A, and rotatable shaft 46C would move circular blade 60 toward and away from power-driven sharpening wheel E by sliding through the bore contained in main body 40C of adjustable tool holder C. Likewise, in FIG. 9, rather than horizontally extending slidable base AA moving forward and rearward, toward and away from power-driven sharpening wheel E, horizontally extending slidable base AA would be held stationary on rails 12A and 14A, and rotatable shaft 46C would move circular blade 60 toward and away from power-driven sharpening wheel E by sliding through the bore contained in main body 40C of adjustable tool holder C.

It is to be understood by one of ordinary skill in the art that the present discussion is a description of exemplary embodiments only and is not intended as limiting the broader aspects of the present invention.

What is claimed is:

1. An apparatus for sharpening a circular blade comprising:

a platform and base assembly;

a slidable standard capable of forward and rearward movement along said platform and base assembly;

an adjustable tool holder carried by said slidable standard, said tool holder comprising a rotatable shaft supported for rotation, and a main body that is angularly adjustable;

a blade holder comprising a blade-centering pin for releasably locking said circular blade to said adjustable tool holder in a plane perpendicular to a longitudinal axis of said rotatable shaft of said tool holder; and a power-driven sharpening wheel.

2. The apparatus of claim 1, wherein said platform and base assembly comprises a platform and a rail which extends along said platform, wherein said slidable standard is mounted on said rail for sliding toward said power-driven sharpening wheel or away from said power-driven sharpening wheel.

3. The apparatus of claim 2, wherein said sliding of said slidable standard toward and away from said power-driven sharpening wheel is accomplished manually.

4. The apparatus of claim 2, wherein said platform and base assembly further comprises a stop which limits said sliding of said slidable standard along said rail toward or away from said power-driven sharpening wheel.

5. The apparatus of claim 4, wherein said stop is equipped with a means for adjusting the position at which said slidable standard is stopped relative to said power-driven grinding wheel.

6. The apparatus of claim 1, wherein said circular blade is a two-sided blade.

7. The apparatus of claim 1, wherein said power-driven sharpening wheel is a grinding wheel.

8. The apparatus of claim 2, wherein said slidable standard comprises:

a bottom portion comprising a bearing configured to slide along said rail for forward and rearward movement toward and away from said power-driven grinding wheel; and a bifurcated upper portion comprising two vertically extending legs that provide a space between said vertically extending legs.

9. The apparatus of claim 2, wherein said slidable standard comprises:

a bottom portion comprising a bearing configured to slide along said rail for forward and rearward movement toward and away from said power-driven grinding wheel; and an upper portion comprising one vertically extending leg.

10. The apparatus of claim 8, wherein said space between said vertically extending legs of said slidable standard houses said adjustable tool holder, and wherein said adjustable tool holder comprises:

a main body comprising a bore extending longitudinally through said main body;

a rotatable shaft that extends through said bore of said main body;

a handle located at the rear of said rotatable shaft wherein said handle is turned to rotate said rotatable shaft and said circular blade during sharpening and to load and unload said circular blade from said apparatus; and a blade-receiving member located at the front of said rotatable shaft for receiving said circular blade for sharpening.

11. The apparatus of claim 10, wherein said handle is turned manually.

12. The apparatus of claim 10, wherein said adjustable tool holder is angularly adjustable relative to said power-driven sharpening wheel.

13. The apparatus of claim 12, wherein said blade-centering pin of said blade holder comprises a head, a shoulder that fits the inside diameter of said circular blade, and a threaded portion.

14. The apparatus of claim 13, wherein loading of said circular blade onto said apparatus occurs by loading said circular blade onto said shoulder of said blade-centering pin and inserting said threaded portion of said blade-centering pin into a threaded hole in said blade-receiving member, wherein said handle at the rear of said rotatable shaft is turned to rotate said shaft and said blade-receiving member, thereby locking said blade-centering pin and said circular blade on said blade-receiving member for sharpening.

15. The apparatus of claim 1, wherein said power-driven sharpening wheel comprises a safety eyeshield.

16. An apparatus for sharpening a circular blade comprising:

a platform and base assembly comprising a rail and a horizontally extending slidable base capable of forward and rearward movement along said rail;

a standard;

an adjustable tool holder carried by said standard, said tool holder comprising a rotatable shaft supported for rotation and a main body that is angularly adjustable;

a blade holder comprising a slidable locking cam for releasably locking said circular blade to said adjustable tool holder in a plane perpendicular to a longitudinal axis of said rotatable shaft of said tool holder; and a power-driven sharpening wheel.

17. The apparatus of claim 16, wherein said blade holder further comprises: a cam guide disc carried by said rotatable shaft, wherein said cam guide disc is adapted to receive said slidable locking cam; a retaining disc; and a removable blade-centering pin.

18. The apparatus of claim 17, wherein said circular blade is carried between said retaining disc and said removable blade-centering pin and wherein said slidable locking cam engages said blade-centering pin to lock said blade-centering pin and said circular blade into place on said apparatus for sharpening.

19. The apparatus of claim 18, wherein said slidable locking cam comprises an inclined surface that engages said removable blade-centering pin and pulls said blade-centering pin rearward thereby locking said blade-centering pin and said circular blade into place on said apparatus for sharpening.

20. An apparatus for sharpening a circular blade comprising:

a platform and base assembly;

a slidable standard capable of forward and rearward movement along said platforrn and base assembly;

an adjustable tool holder carried by said slidable standard, said tool holder comprising a rotatable shaft supported for rotation, and a main body that is angularly adjustable;

a locking member comprising: a removable blade-centering pin having an enlarged head on its remote end; and a compressible member, wherein longitudinal force is applied to said blade-centering pin so that said enlarged head of said blade-centering pin compresses said compressible member against an outer surface of said circular blade for securely holding said circular blade on said adjustable tool holder in a plane perpendicular to a longitudinal axis of said rotatable shaft of said tool holder; and a power-driven sharpening wheel.

* * * * *